United States Patent [19]

Zeigler

[11] Patent Number: 4,512,097

[45] Date of Patent: Apr. 23, 1985

[54] DISPLAY PANEL MOUNTING CLIP

[76] Inventor: Theodore R. Zeigler, 9923 Indian Queen Point Rd., Oxon Hill, Md. 20022

[21] Appl. No.: 403,363

[22] Filed: Jul. 30, 1982

[51] Int. Cl.[3] ..... G09F 7/02

[52] U.S. Cl. ..... 40/611; 40/10 R; 40/617; 40/610

[58] Field of Search ..... 160/378, 328; 52/81; 40/611, 603, 617, 610, 606, 10 R; 24/201 R

[56] References Cited

U.S. PATENT DOCUMENTS

| | | | |
|---|---|---|---|
| 1,484,231 | 2/1924 | Pistocco | 40/617 |
| 1,873,178 | 8/1932 | Bernstein | 40/603 |
| 3,899,843 | 8/1975 | Doyle et al. | 40/603 |
| 3,968,808 | 7/1976 | Zeigler | 52/81 |
| 4,268,000 | 5/1981 | Ulm | 40/603 |

*Primary Examiner*—Gene Mancene
*Assistant Examiner*—Wenceslao J. Contreras
*Attorney, Agent, or Firm*—Diller, Ramik & Wight

[57] ABSTRACT

This disclosure relates to a clip for mounting display panels upon display frames, particularly portable display frames of the self-locking type, the mounting clip including a clip body having a plurality of arms, a sleeve on each arm, each sleeve carrying a hook-like projection for entering an opening of an associated display panel and a spring connected to the sleeves for drawing the sleeves toward a center of the clip body whereby the projections exert a tensioning force upon an associated display panel holding the same in position thereupon and in accurate registration with adjacent associated display panels.

45 Claims, 8 Drawing Figures

7
7
8
8
10
60
61
62
70
83
86
87
88
90
100
102
103
104
110

5
5
10
25
26
32
33
41
93
94
95
100
102
103
104
110

10
32
41
60
61
62
70
80
81
82
83
84
86
87
90
93
94
95
100
102

110
111
112

25
26
83
84
85
93
94
111
112

80
81
82
83
84
85
86
87
88
90
93
94
95
100
101
111
112

DISPLAY PANEL MOUNTING CLIP

CROSS-REFERENCED TO RELATED PATENTS

This application is related to the subject matter of U.S. Pat. Nos. 3,968,808; 4,026,313; 4,280,521 and 4,290,244 which issued on July 13, 1976; May 31, 1977; July 28, 1981 and Sept. 22, 1981, respectively, in the sense that the latter patents, all of which are in the name of Theodore R. Zeigler, are directed to collapsible self-supporting structures and/or display stands, their associated hubs and display panels.

BACKGROUND OF THE INVENTION

In my aforesaid patents certain basic features of self-supporting structures are disclosed, and the disclosures of such patents are incorporated herein by reference.

BRIEF SUMMARY OF THE INVENTION

The present invention is directed to collapsible, self-supporting structures of the type disclosed in the latter-noted patents whether of spherical shape, arch-like shape, planar, curved, etc. which can be readily collapsed and erected and to which sheets, as in the case of tents or panels as in the case of display stands, can be attached. The specific construction of the collapsible, self-supporting structures or display stands and the manner in which the same can be erected or set up and collapsed are relevant herein only insofar as the specific invention disclosed and claimed herein is directed toward utilizing hubs of such collapsible self-supporting and self-locking display stands or like structures as the mounting points for display panel mounting clips for retaining display panels with graphic material thereon upon the display stands or structures.

In accordance with the foregoing, the present invention is directed to a collapsible self-locking portable display stand which, as in the latter-noted patents, includes a plurality of sections each formed from a plurality of pairs of crossed rods with the rods being pivotally connected to associated hubs having central openings therein with the hubs in the erected or set-up-condition of the display stand setting-off corners of the sections and points of attachment for a plurality of display panels. The display panels have corners with an opening in each corner, and a display panel mounting clip is associated with these display panel corner openings to mount the display panels upon the display stands.

More specifically, the display panel mounting clip of this invention includes a clip body having a central body portion and at least one arm, although four arms are preferable, with the four arms defining generally equal angles therebetween and a post projecting from the central body portion and being received in one of the hub openings for mounting the clip to the portable display stand. A sleeve is carried by each arm and a hook-like projection is carried by each sleeve and is received in an associated display panel corner opening to thus mount each display panel upon the display stand or frame.

According to a further aspect of this invention, means are provided for exerting a tensioning force on each display panel through its associated corner opening to assure retention of each panel upon the display stand in accurate registration with adjacent display panels. The means for creating this tensioning force is preferably a closed resilient loop, preferably a spring, which is connected to the sleeves and draws the same toward the center portion of the clip. Alternatively, the tensioning force means might simply be created through bifurcated arm portions of each arm whose natural resilience tends to urge the sleeves toward the clip central portion.

Thus, the present invention resides in the manner in which display panels are connected to collapsible self-supporting and self-locking structures, specifically display stands or frames, through the novel display panel mounting clip more specifically illustrated, described and claimed herein.

BRIEF DESCRIPTION OF THE DRAWING FIGURES

Figure 1:
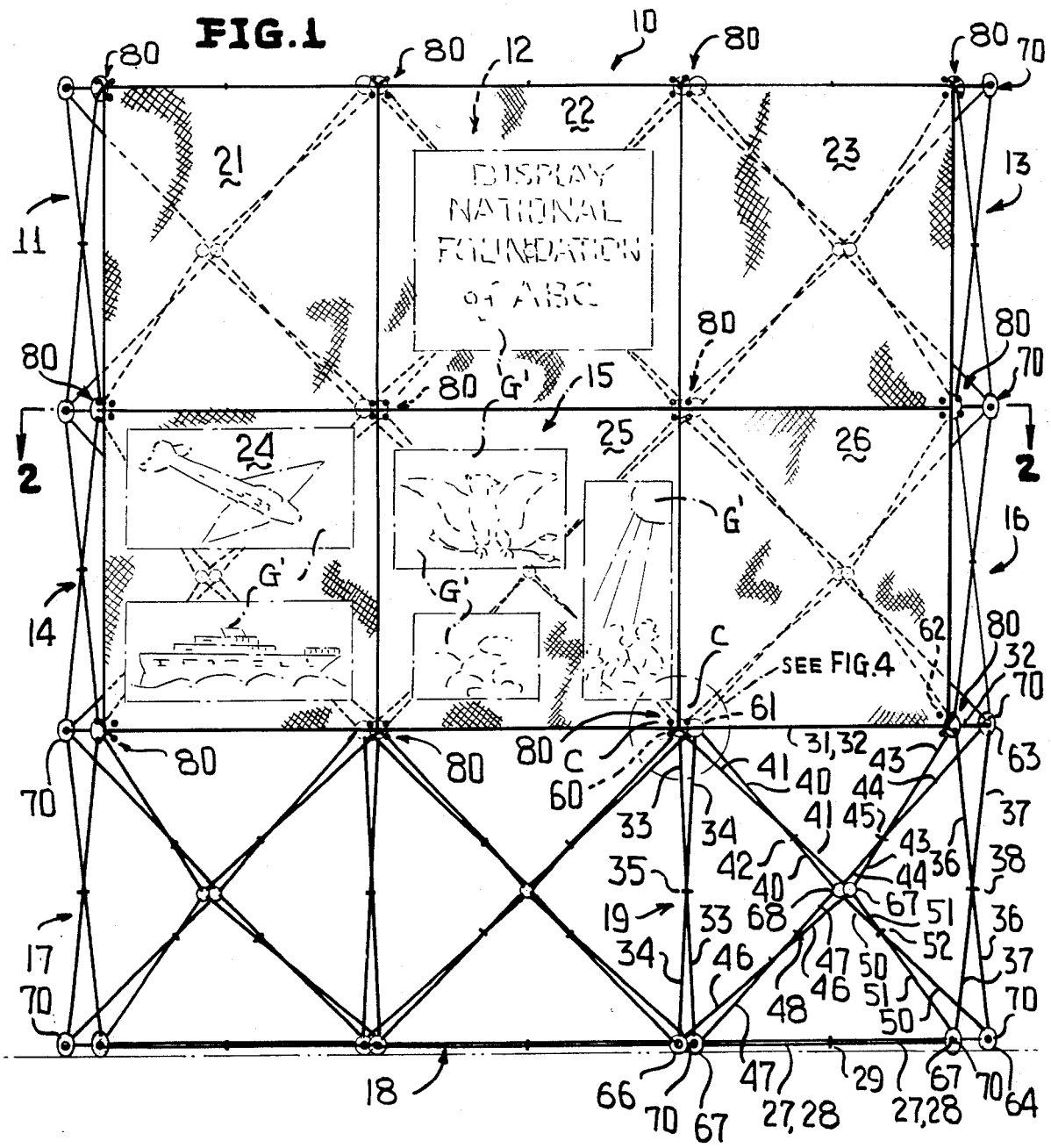
FIG. 1 is a perspective front elevational view of a collapsible self-locking, self-supporting display stand or frame, and illustrates a plurality of sections thereof formed by a plurality of pairs of crossed rods with the rods being joined at a number of corners and centrally of the corners of each section by associated hubs.
Figure 2:
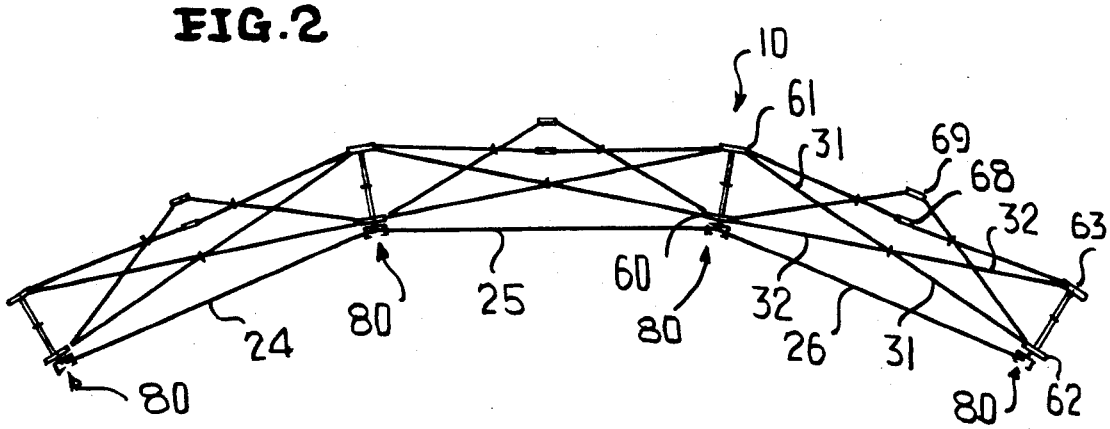
FIG. 2 is a top plan view looking downwardly in FIG. 1 and illustrates the manner in which display panels with graphic material thereon are secured to selected sections of the display stand.

FIGS. 1 and 2 illustrate a collapsible self-locking, self-supporting portable display stand, frame or structure which is generally designated by the reference numeral 10 and is formed of a plurality of sections each of a generally rectangular configuration with nine such sections being illustrated and being generally identified by reference numerals 11–19. A display panel 21–26 having appropriate graphics G' thereupon is secured to the respective sections 11–16. Since the sections 11–19 are identical the following detailed description of the section 19 is equally applicable to the sections 11–18. The section 19 of the display stand 10 includes a bottom horizontally disposed pair of crossed rods or tubes 27, 28 pivotally connected at 29; a top pair of crossed rods or tubes 31, 32 likewise pivoted to each other (not shown) at a point corresponding to the pivot point 29 of the crossed rods 27, 28; a pair of vertical crossed rods or tubes 33, 34 pivotally interconnected by a pivot pin 35, and another pair of vertical crossed rods or tubes 36, 37 pivotally connected at a pivot pin 38. Four other pairs of crossed rods are also pivotally interconnected, namely, the crossed rods or tubes 40, 41 pivotally connected at 42; crossed rods or tubes 43, 44 pivotally connected at 45; crossed rods or tubes 46, 47 pivotally connected at 48 and crossed rods or tubes 50, 51 pivotally connected at 52.

Figure 5:
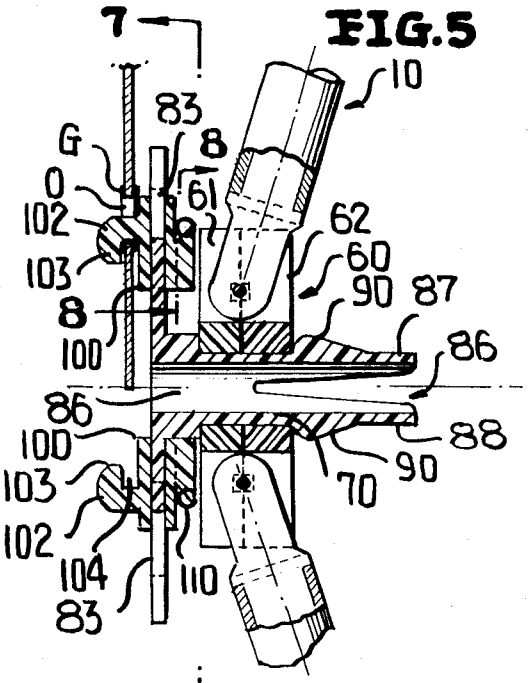
FIG. 5 is a cross-sectional view taken generally along line 5—5 of FIG. 4, and illustrates the manner in which a post extending from a central portion of the clip body retains the same to the associated hub, while hook-like projections of sleeves slidably carry on arms of the clip engage in openings of the display panel corners.
Figure 3:
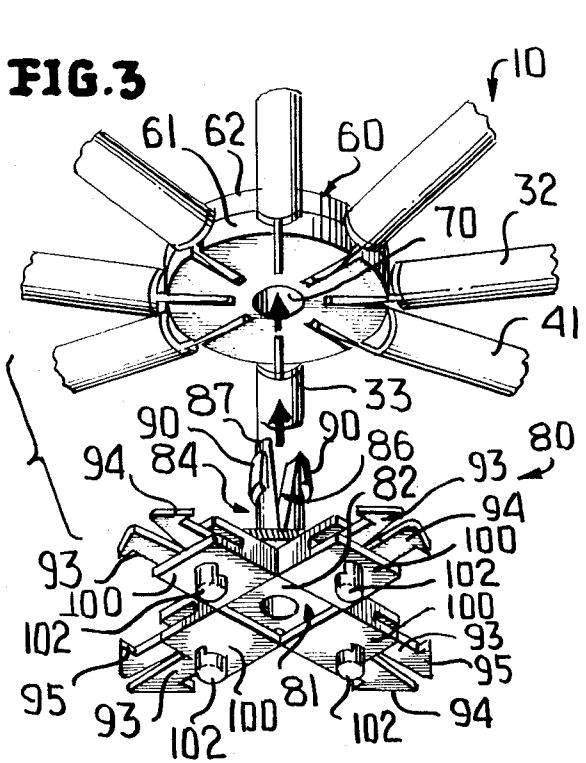
FIG. 3 is a perspective view of one of the plurality of hubs of the display stand, and illustrates a novel display panel mounting clip of this invention prior to being secured to the hub.
Figure 8:
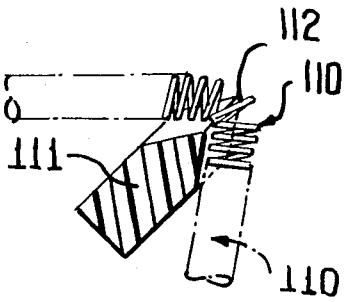
FIG. 8 is an enlarged sectional view taken generally along line 8—8 of FIG. 5 and illustrates the manner in which a knife-edge of a projection on the rear of one of the sleeves retains the spring in position.

The rods are connected to associated hubs 60–69 with the details of the construction of these hubs being best illustrated in FIGS. 3 and 5 relative to the hub 60 and in U.S. Pat. No. 4,280,521. However, in lieu of the use of a screw to hold two hub bodies 61, 62 together to retain therebetween a wiring 63 to which the rods are connected as in U.S. Pat. No. 4,280,521, the hub bodies 61, 62 are adhesively secured to each other, but the latter forms no part of this invention. However, it is to be particularly noted that due to the latter construction, each jub 60–69 has a central bore or opening 70.

Figure 4:
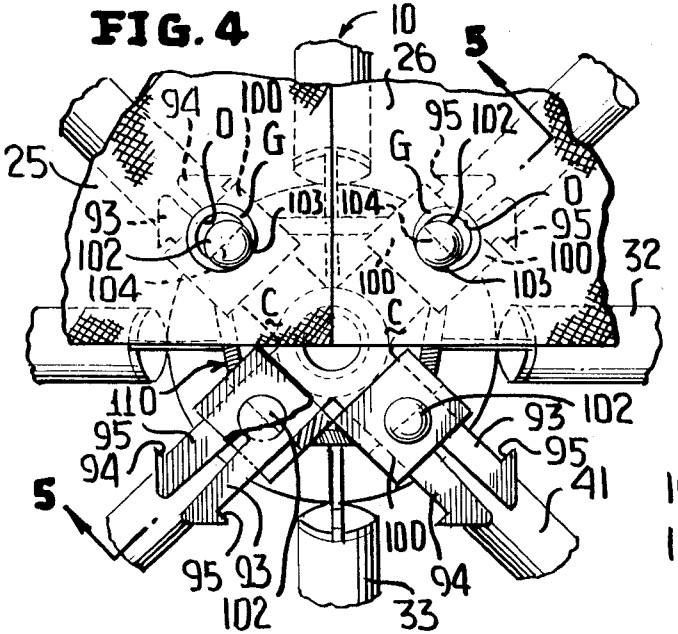
FIG. 4 is an enlarged front elevational view of the encircled portion of FIG. 1, and illustrates the display panel mounting clip secured to the hub and in turn having secured thereto a pair of display panels.

The rods 33, 41 and 32 of the section 19 are pivotally connected to the hub 60, as is best illustrated in FIGS. 3 and 4 of the drawings. Four other rods shown in FIG. 3 (unnumbered) forming portions of the sections 15, 16 and 18 are also pivotally connected to the hub 60 and this relationship of eight rods pivotally connected to the hub 60 is carried through the overall display stand for all of the inboard hubs while lesser numbers of rods are connected to the outboard hubs, again in the manner more specifically described in the latter-noted patents. Suffice it to say that each forwardmost hub 60, 62, 65 and 66 in FIG. 1 is adapted to have secured thereto a display panel identical to any one of the display panels 21–26 by a mounting clip which is generally designated by the reference numeral 80 as is best illustrated in FIGS. 3–8 of the drawings, and a like clip 80 is so utilized at each corner of the sections 11 through 16.

Each display panel mounting clip 80 is particularly adapted to mount each display panel 21–26 upon the display stand 10 through an associated opening O (FIGS. 4 and 5) reinforced by a metal grommet G at each corner C of each of the display panels 21–26, again as is best illustrated in FIGS. 4 and 5 of the drawings.

Each display panel mounting clip 80 includes a clip body 81 having a central portion 82 and four identical arms each identified by the reference numeral 83. Extending from the underside (unnumbered) of the central portion 82 is a projection or post 84 which is generally tubular and includes a relatively thick reinforcing collar 85 and a bifurcated stem 86 having a pair of stem portions 87, 88 each of which carries identical means 90 in the form of tapered shoulders or projections which engage behind the hubs 60 (FIG. 5) when each post 84 is inserted into an associated opening 70 of an associated forwardmost hub 60, 62, for example. The stem portions 87, 88 are deflected temporarily inward toward each other during the insertion of the same into the hub opening 70 but when the projections 90 pass beyond the opening 70 the inherent resilience of the plastic material from which the clip is constructed causes the stem portions 87, 88 to rebound to the position shown in FIG. 5 resulting in each clip 80 being locked to its associated hub. In order to remove each clip 80 from its associated hub 60 the stem portions 87, 88 must be depressed so that the projections 90 can again clearly pass through the opening 70 of the associated hub. Thus, the projections or means 90 function to prevent inadvertent removal of each post 84 from its associated hub opening 70 and thus prevents the clips 80 from being inadvertently removed from their associated hubs 60, 62, 65, 66 and any of the other forwardmost hubs of the sections 11–18.

Figure 7:
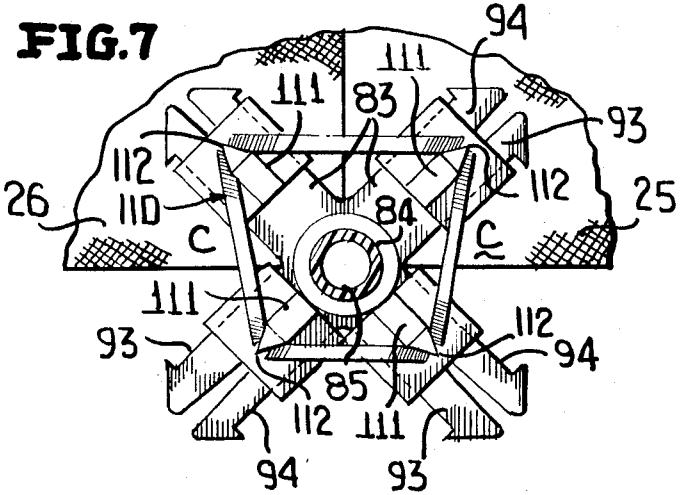
FIG. 7 is a cross-sectional view taken generally along line 7—7 of FIG. 5 and illustrates the manner in which a continuous spring loop connected to the sleeves exerts a tensioning force upon the display panels to maintain accurate alignment therebetween.
Figure 6:
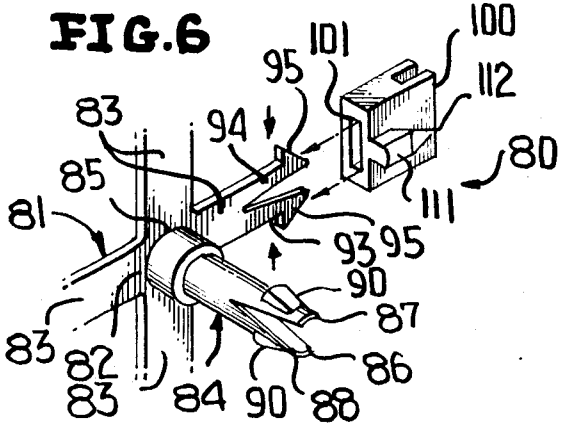
FIG. 6 is a fragmentary perspective view of a portion of the clip of this invention and illustrates the manner in which one of the bifurcated arms must be temporarily deformed to slide the associated sleeve thereon.

Each arm 83 is bifurcated and includes identical ram portions 93, 94, each carrying identical means 95 in the form of shoulders or abutments for preventing an associated sleeve 100 from being inadvertently removed from an associated arm 83 when once positioned thereupon. The sleeves 100 are positioned upon each arm 83 by first moving the arm portions 93, 94 toward each other as indicated by the unnumbered headed arrows associated therewith in FIG. 6 and then simply sliding each sleeve 100 such than an associated rectangular through bore 101 thereof slides upon and is fully seated between the projections 95 and the central portion 82 of the clip 80, as is best illustrated in FIGS. 3, 4 and 7 of the drawings. Once the sleeve 100 has passed the projections 95 of its associated arm 83, the inherent resilience of the plastic material of the arms causes the same to rebound to the normal positions thereof (FIGS. 4 and 7) at which point the projections 95 preclude the sleeves 100 from being inadvertently removed from the associated arms 83 without the arm portions 93, 94 again being deflected toward each other to permit the free passage and intentional removal of the sleeves 100 from the associated arms 83.

Each of the sleeves 100 constitutes means movably mounted upon the arms 83 of the clip body 81 for attachment to the associated display panels 21–26 through means in the form of hook-like projections 102 carried thereby. Each hook-like projection 102 includes a nose 103 defined by an undercut slot or groove 104 which engages a portion of the grommet G of the associated opening O (FIG. 5) resulting in the nose 103 overlying a portion of the grommet and the associated display panel. In this manner each corner C is secured through its associated opening O to the projections 102 of the display panel mounting clip 80 associated with a particular display panel. Furthermore, since the arm portions 93, 94 diverge outwardly the forces causes by the resilient nature of the material thereof tend to urge the sleeves in the direction toward the central portion 82 of each clip body 81 thereby pulling or drawing the corners C of adjacent display panels toward each other and toward the central portion 82 of the clip 80, as is best illustrated in FIG. 4 to retain the display panels upon the associated display stand in accurate registration with each other. The latter is particularly desirable to make certain that the graphics G′ upon the various display panels 21–26 are in suitable alignment.

In order to fully assure proper retention of the display panels 21–26 upon the display stand 10 with a desired degree of tension or tautness, means are provided in the form of a continuous resilient loop or spring 110 which encircles the post 84 and is entrained about a generally triangular knife-like post 111 having a forward edge 112 carried by each sleeve 100. Each knife-edge 112 of each post 111 is slightly outwardly concave (FIG. 5) and thereby retains the spring 110 thereupon while the edge 112 tends to bite into and spread adjacent loops of the spring to prevent disengagement of the spring 110 from the associated post 111. The tension of the spring 110 normally draws each of the sleeves 100 to the position shown in FIG. 3 of the drawing at which each sleeve 100 is drawn as far as possible toward the center portion 82 of the clip 80.

The openings O in each corner C of each display panel 21–26 are so formed that the sleeves 100 must be drawn away from the center portion 82 before the projections or stems 102 can be inserted into the openings O. Once the latter occurs the natural resilience of the spring 100 pulls the sleeves 100 back toward the central portion 82 and these tension forces are transmitted from the spring 110 through the stems 102 to each corner C of each display panel 21–26 thereby bringing the corners C in intimate relationship, as is best illustrated by the corners C of display panels 25–26 in FIG. 4. This assures that all of the display panels 21–26 are securely held to their associated posts 102 which therefore results in the panels 21–26 being held in taut relationship upon the display stand 10 resulting in an esthetic appearance of the graphics G thereupon. Obviously, in order to remove the display panels 21–26 from their associated display mounting clips 80, the sleeves 100 need but be drawn toward the center portion 82 of the associated clip 80 and the opening O at each corner C can be readily removed from the associated stem or projection 102.

The display stand 10 of FIG. 1 has been illustrated with six display panels 21–26 thereupon which requires twelve of the mounting clips 80 to hold the display panels thereon. However, while each of the clips 80 has four arms and thus four projections 102, it should be noted that all four projections 102 of only the two inboardmost clips 80 are utilized in securing thereto the corners of the display panels 21, 22, 24, 25 and 22, 23, 25 26. At the uppermost lefthand corner of the display panel 21, the lowermost lefthand corner of the display panel 24, the uppermost righthand corner of display panel 23 and the lowermost righthand corner of display panel 26, only one sleeve 100 and its associated stem or hook-like projection 102 is utilized to secure that particular corner of the display panels to the associated clip. Finally, only two sleeves 100 and their associated hook-like projections 102 are utilized along the inboard uppermost edges adjacent the corners of the display panels 21, 22 and 22, 23 with a like number (two) of sleeves and projections 102 being utilized with the similar inboard corners of the display panels 24, 25 and 25, 26. Therefore, though each display panel mounting clip has four arms and thus can be utilized to singularly hold a corner of four different panels to an associated hub, each clip 80 can also be utilized to engage one, two, or three corners of adjacent display panels.

What is claimed is:

1. A display panel mounting clip comprising a clip body, means for mounting the clip body upon a display stand upon which at least one display panel is adapted to be secured, means movably mounted upon said clip body for attachment to a display panel, and means operative through said display panel attachment means for exerting a tensioning force upon an associated display panel to retain the same upon an associated display stand in accurate registration with adjacent display panels.

2. The display panel mounting clip as defined in claim 1 wherein said display panel tensioning means is a spring.

3. The display panel mounting clip as defined in claim 1 wherein said display panel attachment means is mounted for sliding movement relative to said clip body.

4. The display panel mounting clip as defined in claim 1 including means carried by said display panel attachment means for releasably attaching said display panel attachment means to a display panel.

5. The display panel mounting clip as defined in claim 1 including means carried by said display panel attachment means for releasably attaching said display panel attachment means to a display panel, and said releasably attaching means being a projection for entering an opening of a display panel.

6. The display panel mounting clip as defined in claim 1 including means carried by said display panel attachment means for releasably attaching said display panel attachment means to a display panel, and said releasably attaching means being a hook-like projection for entering an opening of a display panel.

7. The display panel as defined in claim 1 including means for preventing the inadvertent disassembly of said display panel attachment means from said clip body.

8. The display panel as defined in claim 1 wherein said clip body mounting means is a post adapted for insertion into an opening of an associated display stand.

9. The display stand as defined in claim 1 wherein said clip body includes an elongated arm, and said display panel attachment means is slidably carried by said arm.

10. The display stand as defined in claim 1 wherein said display panel tensioning means is an endless loop of resilient material.

11. The display panel mounting clip as defined in claim 2 wherein said display panel attachment means is mounted for sliding movement relative to said clip body.

12. The display panel mounting clip as defined in claim 2 including means carried by said display panel attachment means for releasably attaching said display panel attachment means to a display panel.

13. The display panel mounting clip as defined in claim 2 including means carried by said display panel attachment means for releasably attaching said display panel attachment means to a display panel, and said releasably attaching means being a projection for entering an opening of a display panel.

14. The display panel mounting clip as defined in claim 2 including means carried by said display panel attachment means for releasably attaching said display panel attachment means to a display panel, and said releasably attaching means being a hook-like projection for entering an opening of a display panel.

15. The display panel as defined in claim 2 including means for preventing the inadvertent disassembly of said display panel attachment means from said clip body.

16. The display panel as defined in claim 2 wherein said clip body mounting means is a post adapted for insertion into an opening of an associated display stand.

17. The display panel mounting clip as defined in claim 3 including means carried by said display panel attachment means for releasably attaching said display panel attachment means to a display panel.

18. The display panel mounting clip as defined in claim 3 including means carried by said display panel attachment means for releasably attaching said display panel attachment means to a display panel, and said releasably attaching means being a projection for entering an opening of a display panel.

19. The display panel mounting clip as defined in claim 3 including means carried by said display panel attachment means for releasably attaching said display panel attachment means to a display panel, and said releasably attaching means being a hook-like projection for entering an opening of a display panel.

20. The display panel as defined in claim 3 including means for preventing the inadvertent disassembly of said display panel attachment means from said clip body.

21. The display panel as defined in claim 3 wherein said clip body mounting means is a post adapted for insertion into an opening of an associated display stand.

22. The display panel as defined in claim 4 including means for preventing the inadvertent disassembly of said display panel attachment means from said clip body.

23. The display panel as defined in claim 4 wherein said clip body mounting means is a post adapted for insertion into an opening of an associated display stand.

24. The display panel as defined in claim 5 including means for preventing the inadvertent disassembly of said display panel attachment means from said clip body.

25. The display panel as defined in claim 5 wherein said clip body mounting means is a post adapted for insertion into an opening of an associated display stand.

26. A display panel mounting clip comprising a clip body, means mounting the clip body upon a display stand upon which at least one display panel is adapted to be secured, said clip body including at least a pair of arms, means movably mounted upon each arm for attachment to a display panel, and means operative through said display panel attachment means for exerting a tensioning force upon an associated display panel to retain the same upon an associated display stand in accurate registration with adjacent display panels.

27. The display panel mounting clip as defined in claim 26 wherein each display panel attachment means includes a sleeve mounted for sliding movement relative to an associated arm, and said display panel tensioning means are defined by bifurcated relatively resilient arm portions of each arm in relative outwardly opening diverging relationship whereby the inherent resilience of said arm portions urges each sleeve in a direction away from its associated display panel.

28. The display panel mounting clip as defined in claim 26 wherein each display panel attachment means includes a sleeve mounted for sliding movement relative to an associated arm, and said display panel tensioning means is defined by an endless loop of resilient material.

29. The display panel mounting clip as defined in claim 26 wherein each display panel attachment means includes a sleeve mounted for sliding movement relative to an associated arm, said display panel tensioning means is defined by an endless loop of resilient material, and means carried by each sleeve for retaining said endless loop thereupon.

30. The display panel mounting clip as defined in claim 26 including means carried by said display panel attachment means for releasably attaching said display panel attachment means to a display panel.

31. The display panel mounting clip as defined in claim 26 including means carried by said display panel attachment means for releasably attaching said display panel attachment means to a display panel, and said releasably attaching means being a projection for entering an opening of a display panel.

32. The display panel mounting clip as defined in claim 26 including means carried by said display panel attachment means for releasably attaching said display panel attachment means to a display panel, and said releasably attaching means being a hook-like projection for entering an opening of a display panel.

33. The display panel as defined in claim 26 including means for preventing the inadvertent disassembly of said display panel attachment means from said clip body.

34. The display panel mounting clip as defined in claim 33 wherein said inadvertent disassembly preventing means includes abutment means carried by at least one arm portion of each arm for preventing the associated sleeve from being withdrawn therefrom.

35. A collapsible self-locking portable display stand comprising a plurality of sections each formed from a plurality of pairs of crossed rods with said rods being pivotally connected to associated hubs, said hubs in the erected condition of said display stand setting-off corners of said sections and points of attachment for at least one associated display panel, at least one display panel, a display panel mounting clip for mounting at least one corner of said display panel to one of said hubs, said display panel mounting clip including a clip body, means for mounting the clip body upon said one hub, and means movably mounted upon said clip body for attachment to said display panel corner.

36. The collapsible self-locking portable display stand as defined in claim 35 including means operative through said display panel corner attachment means for exerting a tensioning force upon an associated display panel through said corner to retain the same in accurate registration relative to the associated section.

37. The collapsible self-locking portable display stand as defined in claim 35 wherein said display panel corner attachment means is mounted for sliding movement relative to said clip body.

38. The collapsible self-locking portable display stand as defined in claim 35 wherein said hub includes an opening, and said hub mounting means is a post carried by said clip body received in said hub opening.

39. The collapsible self-locking portable display stand as defined in claim 35 wherein said display panel corner includes an opening, and said display panel corner attachment means is a hook-like projection received in said panel corner opening.

40. The collapsible self-locking portable display stand as defined in claim 35 wherein said clip body includes an elongated arm, and said display panel corner attachment means is slidably carried by said arm.

41. The collapsible self-locking portable display stand as defined in claim 35 including means operative through said display panel corner attachment means for exerting a tensioning force upon an associated display panel through said corner to retain the same in accurate registration relative to the associated section.

42. A collapsible self-locking portable display stand comprising a plurality of sections each formed from a plurality of pairs of crossed rods with said rods being pivotally connected to associated hubs, said hubs in the erected condition of said display stand setting-off corners of said sections, and points of attachment for a plurality of display panels, a plurality of display panels, a display panel mounting clip for mounting a plurality of corners of a plurality of the display panels to one of said hubs, each hub having an opening, each display panel corner having an opening, said display panel mounting clip including a clip body having a central body portion and four arms defining generally equal angles therebetween, a post projecting from said central body portion and being received in one of said hub openings, said post having means for preventing the inadvertent removal of said post from said one hub opening, a sleeve slidably carried by each arm, a hook-like projection carried by each sleeve received in an associated display panel corner opening, and means connected to said sleeves for exerting a tensioning force on each display panel through its associated corner opening and the hook-like projection therein.

43. The collapsible self-locking portable display stand as defined in claim 42 wherein said tensioning force exerting means is a closed resilient loop.

44. The collapsible self-locking portable display stand as defined in claim 42 including means carried by each of said arms for preventing its associated sleeve from being inadvertently removed therefrom.

45. The collapsible self-locking portable display stand as defined in claim 42 wherein each arm is resilient and bifurcated.

* * * * *